US007530468B1

(12) United States Patent
Garvey

(10) Patent No.: US 7,530,468 B1
(45) Date of Patent: May 12, 2009

(54) DRINKING APPARATUS

(76) Inventor: Patrick J. Garvey, 550 N. Suffolk Ave., Massapequa, NY (US) 11758

( * ) Notice: Subject to any disclaimer, the term of this patent is extended or adjusted under 35 U.S.C. 154(b) by 667 days.

(21) Appl. No.: 11/208,940

(22) Filed: Aug. 23, 2005

(51) Int. Cl.
*B65D 1/24* (2006.01)

(52) U.S. Cl. ..... 220/506; 220/62.12; 220/62.18; 220/345.1

(58) Field of Classification Search ..... 220/62.12, 220/62.18, 345.1, 345.5, 351, 503, 506, 627, 220/524, 526
See application file for complete search history.

(56) References Cited

U.S. PATENT DOCUMENTS 2,864,526 A * 12/1958 Buss ..... 68/139
5,975,333 A * 11/1999 Lee ..... 220/571

* cited by examiner

*Primary Examiner*—Anthony D Stashick
*Assistant Examiner*—Elizabeth Volz
(74) *Attorney, Agent, or Firm*—Crossley Patent Law; Mark Ashley Crossley

(57) ABSTRACT

A drinking apparatus. The drinking apparatus includes a fluid container for containment of liquid and also includes an attached base unit that is designed to collect any overflow of liquid from the fluid container. The top rim of the base unit is curved, having its highest point adjacent to an attached handle and the lowest point opposite the handle. Between the fluid container and the base unit is located a pair of sliding panels that are mounted within a number of grooves. After liquid has been poured but before it is to be drunk, the sliding panels are used to cover the area in between the fluid container and the base unit so that any spilled liquid that has already entered into a fluid reservoir within the base unit will not exit the fluid reservoir while the fluid within the fluid container is being drunk by an individual.

6 Claims, 6 Drawing Sheets

DRINKING APPARATUS

BACKGROUND OF THE INVENTION

The present invention concerns that of a new and improved drinking apparatus specifically it relates to a drip catch beverage mug.

DESCRIPTION OF THE PRIOR ART

U.S. Pat. No. 5,975,333, issued to Lee, discloses a drip catch beverage mug comprising a cylindrical bowl having an open top end and a closed bottom end to receive a beverage liquid therein.

U.S. Pat. No. 3,279,638, issued to Merry, discloses a drinking container that includes an attachment for receiving a drinking container such as a glass to catch any drip or condensation from the outside of this container.

U.S. Pat. No. 196,487, issued to Sherman, discloses a vessel and an attached reservoir adapted to collect any overflow from the vessel and hold the liquid that is collected from the vessel.

U.S. Pat. No. 3,257,024, issued to Sermanchik, discloses convertible tableware.

U.S. Pat. No. D378,264, issued to Lage et al., discloses an ornamental design for a beverage mug.

SUMMARY OF THE INVENTION

The present invention concerns that of a new and improved drinking apparatus. The drinking apparatus includes a fluid container for containment of liquid and also includes an attached base unit that is designed to collect any overflow of liquid from the fluid container. The top rim of the base unit is curved, having its highest point adjacent to an attached handle and the lowest point opposite the handle. Between the fluid container and the base unit is located a pair of sliding panels that are mounted within a number of grooves. After liquid has been poured but before it is to be drunk, the sliding panels are used to cover the area in between the fluid container and the base unit so that any spilled liquid that has already entered into a fluid reservoir within the base unit will not exit the fluid reservoir while the fluid within the fluid container is being drunk by an individual.

There has thus been outlined, rather broadly, the more important features of a drinking apparatus that the detailed description thereof that follows may be better understood and in order that the present contribution to the art may be better appreciated. There are, of course, additional features of the drinking apparatus that will be described hereinafter and which will form the subject matter of the claims appended hereto.

In this respect, before explaining at least one embodiment of the drinking apparatus in detail, it is to be understood that the drinking apparatus is not limited in its application to the details of construction and to the arrangements of the components set forth in the following description or illustrated in the drawings. The drinking apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present drinking apparatus. It is important, therefore, that the claims be regarded as including such equivalent constructions insofar as they do not depart from the spirit and scope of the present invention.

It is therefore an object of the present invention to provide a drinking apparatus which has all of the advantages of the prior art and none of the disadvantages.

It is another object of the present invention to provide a drinking apparatus which may be easily and efficiently manufactured and marketed.

It is another object of the present invention to provide a drinking apparatus which is of durable and reliable construction.

It is yet another object of the present invention to provide a drinking apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
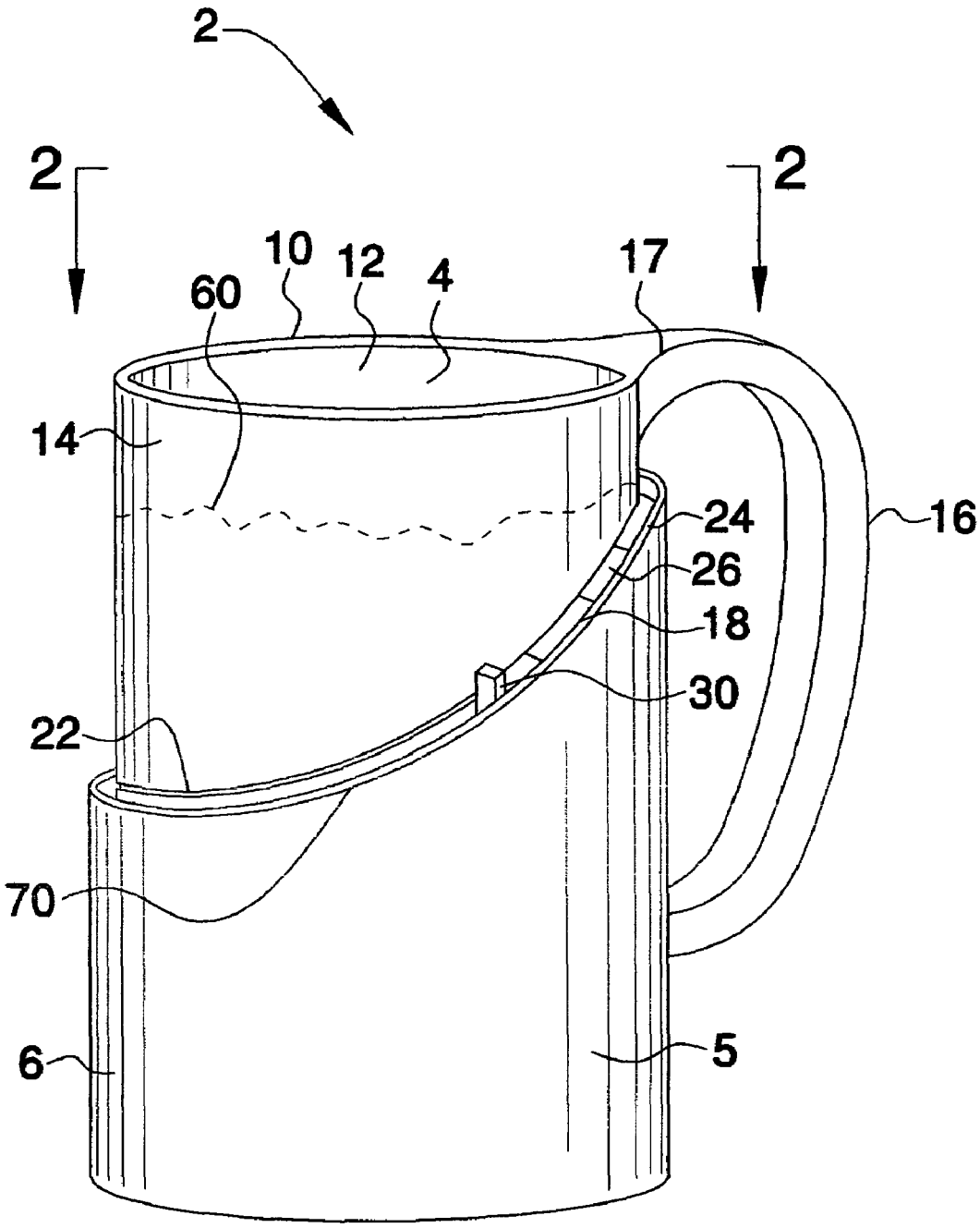
FIG. 1 shows a perspective view of the drinking apparatus.
Figure 2:
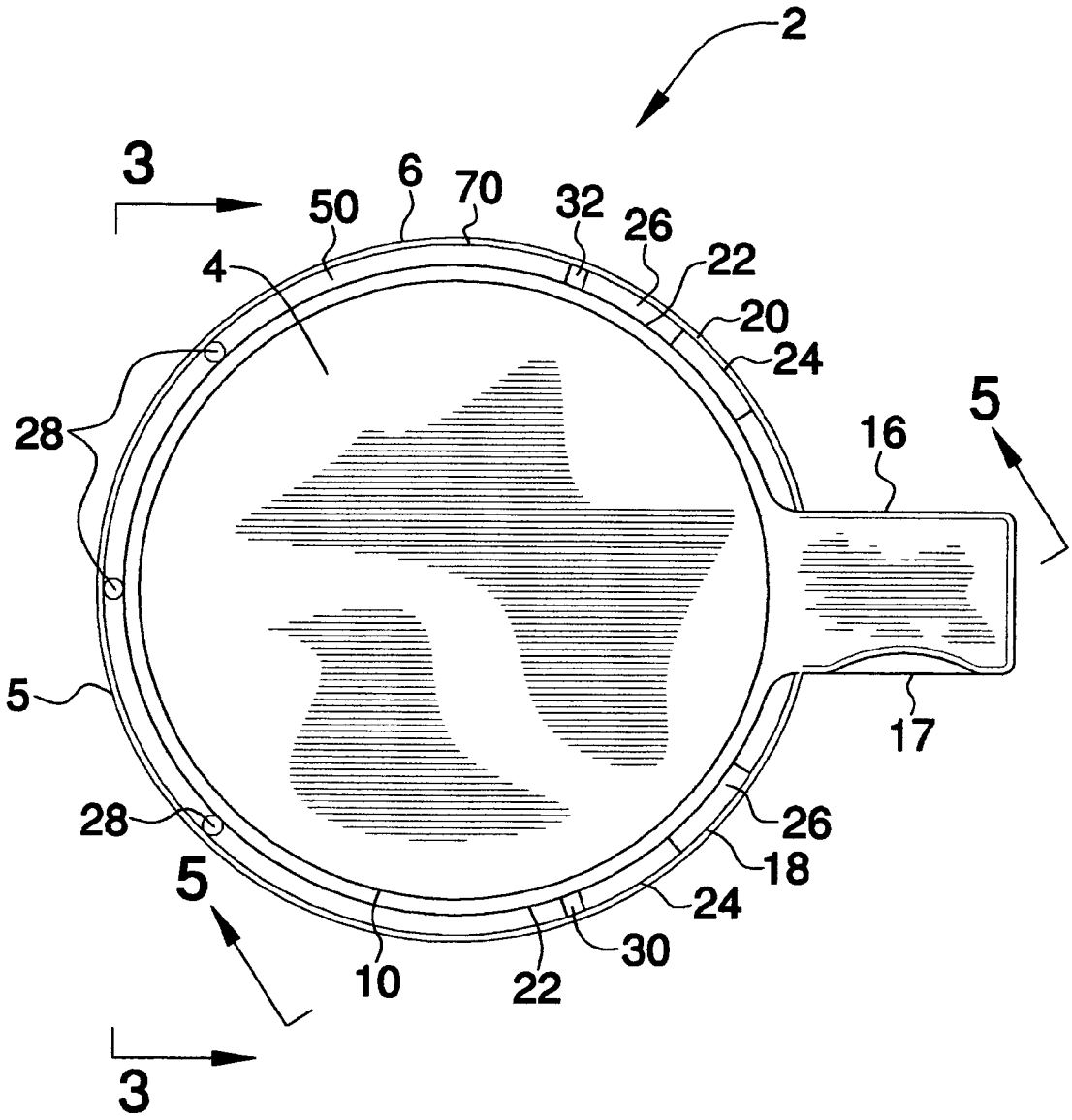
FIG. 2 shows a top view of the drinking apparatus.
Figure 3:
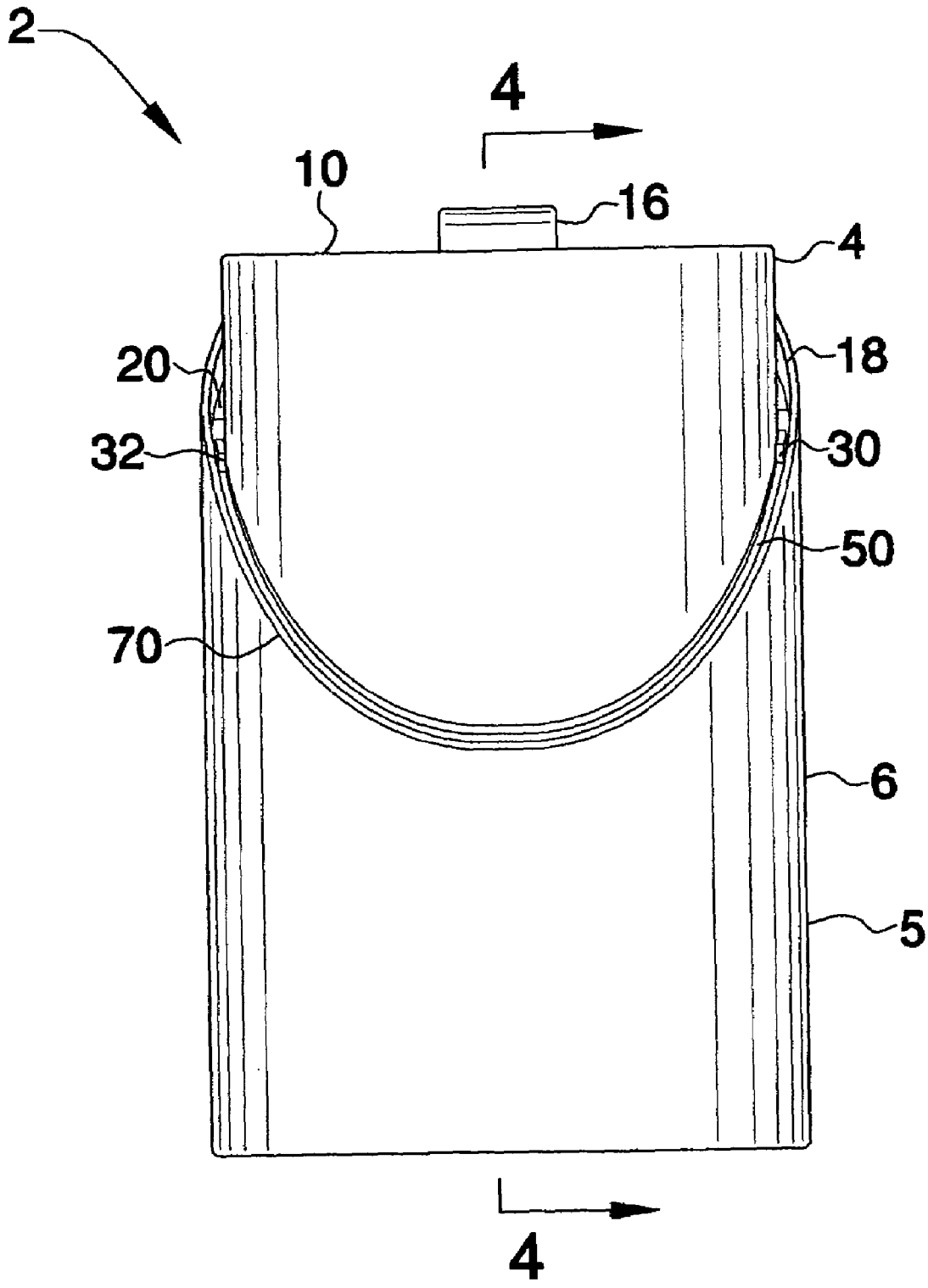
FIG. 3 shows a side view of the drinking apparatus viewed from a location that is one-hundred eighty degrees from the handle.
Figure 4:
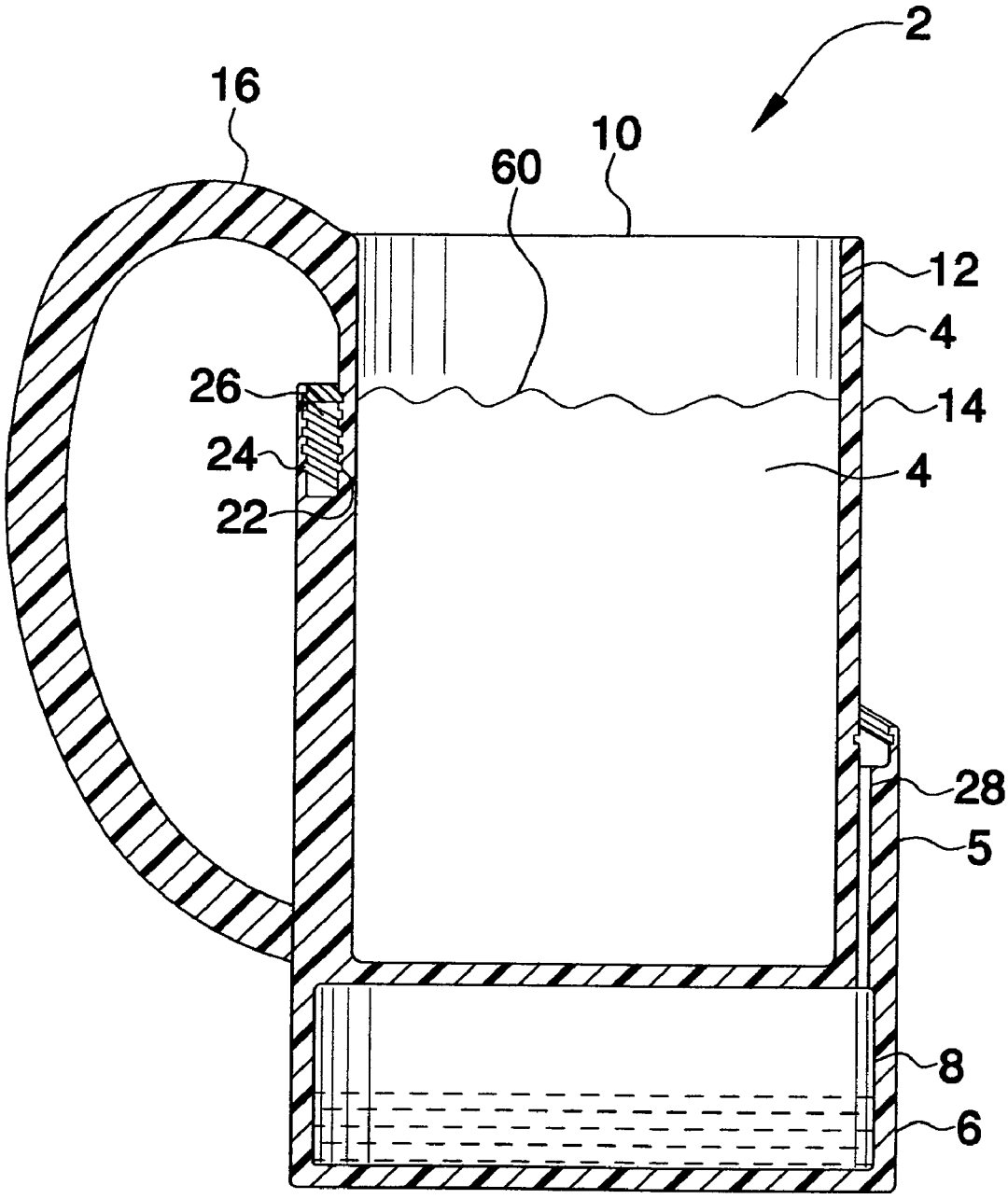
FIG. 4 shows a side view of the drinking apparatus, highlighting the fluid reservoir and the series of inner and outer grooves used to mount the components of the pair of sliding panels.
Figure 5:
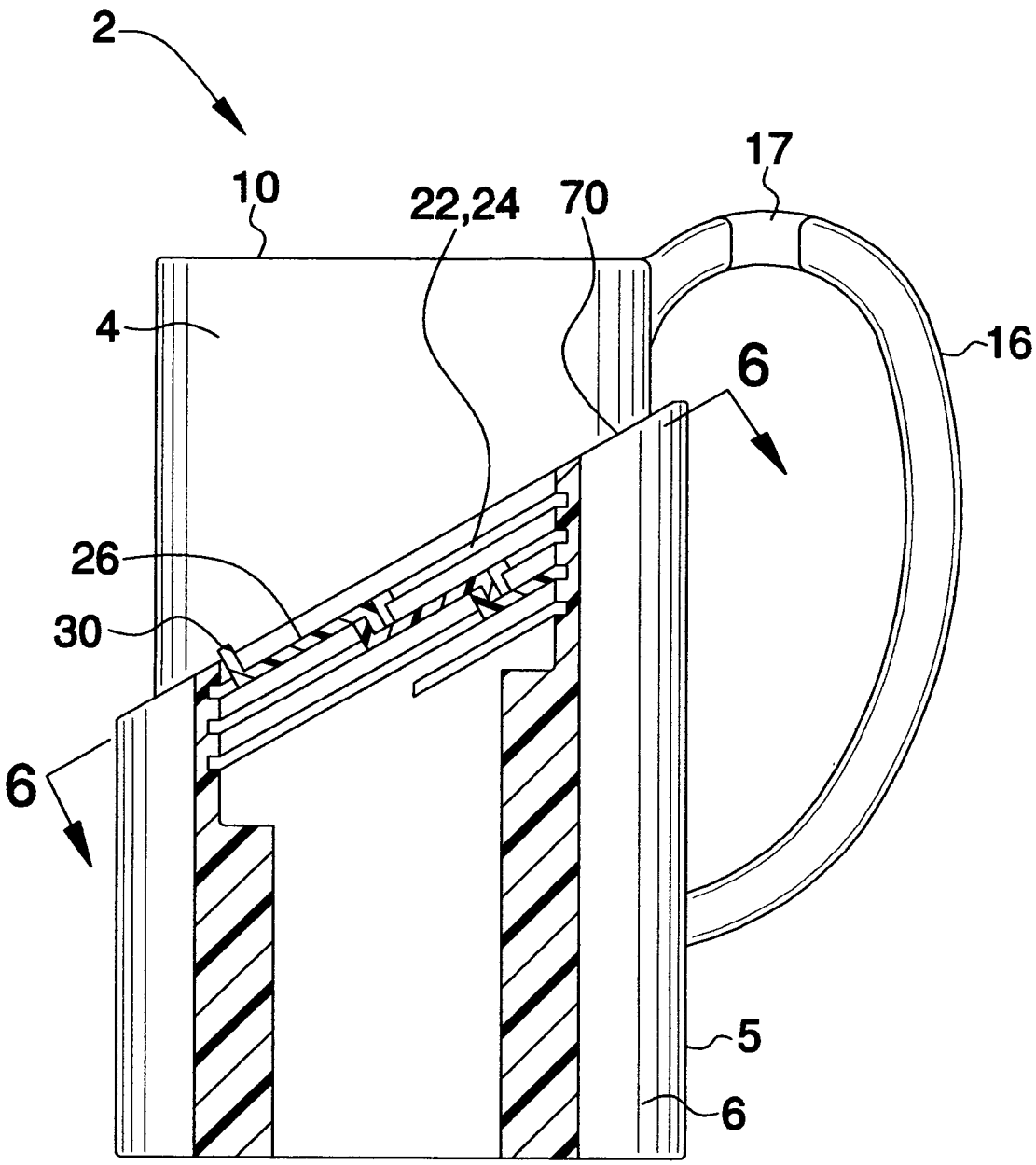
FIG. 5 shows a side view of the drinking apparatus, highlighting the series of inner and outer grooves used to mount the components of the pair of sliding panels.
Figure 6:
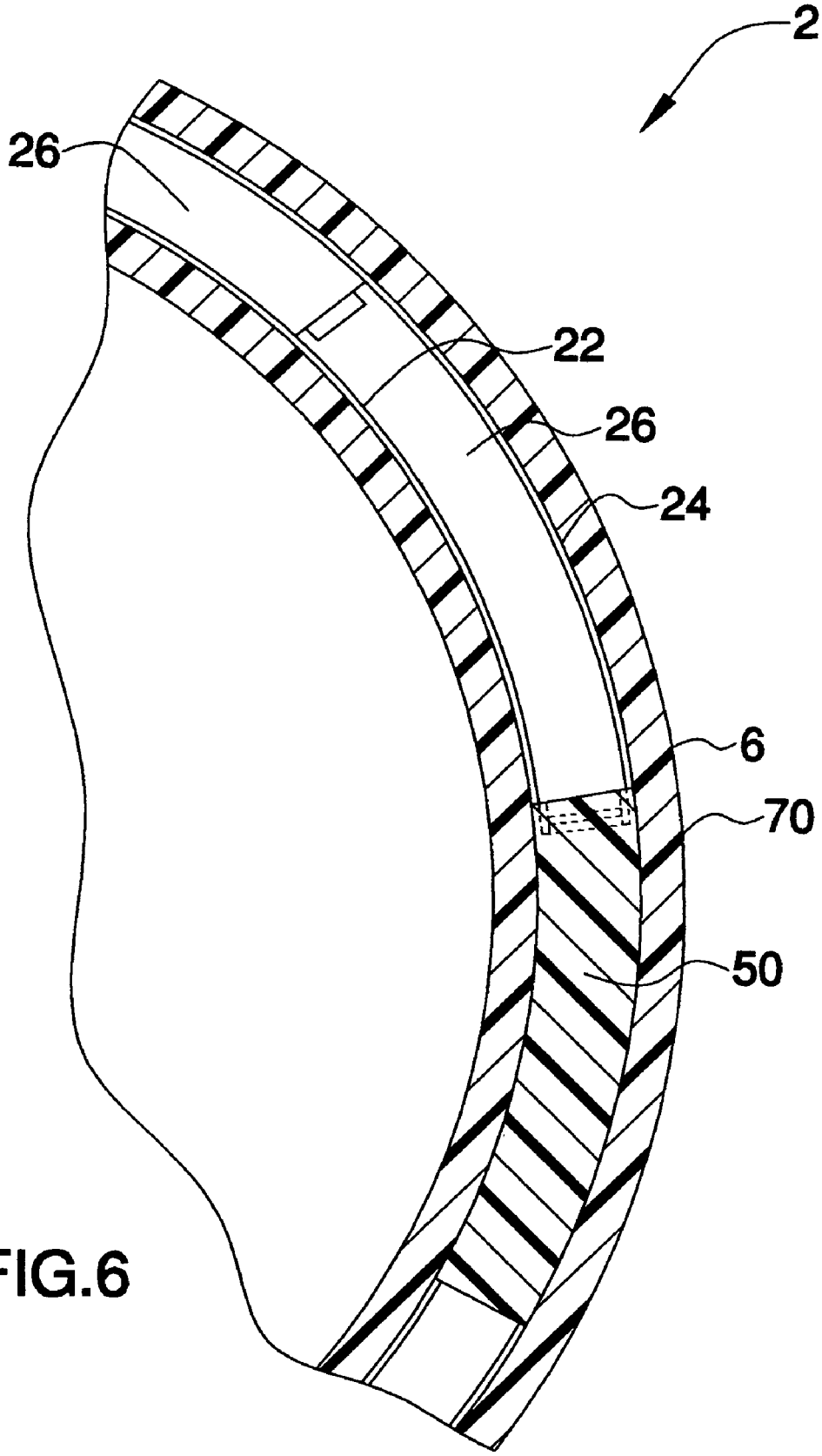
FIG. 6 shows a top view of the drinking apparatus and highlights the components of the pair of sliding panels, showing how they are connected to one another and also are they are integrated within the series of inner and outer grooves.

With reference now to the drawings, and in particular to FIGS. 1 through 6 thereof, a new drinking apparatus embodying the principles and concepts of the present invention and generally designated by the reference numeral 2 will be described.

As best illustrated in FIGS. 1 through 4, the drinking apparatus 2 comprises a base unit 5 and a fluid container 4. The base unit 5 comprises an outer lip 6 and preferably has a circular cross-sectional shape and has a separate fluid reservoir 8 in the bottom. A fluid container 4, usually shaped like a mug or cup, is placed within the base unit 5. The fluid container 4 includes two surfaces, an inner surface 12 and an outer surface 14, and has a top-mounted rim 10.

A handle 16 is attached to the drinking apparatus 2, with the handle 16 having two ends, a top end and a bottom end. The top end of the handle 16 is preferably connected to the outer surface 14 of the fluid container 4 near the rim 10 of the fluid container 4, while the bottom end of the handle 16 is attached to the outer lip 6 of the base unit 5. An indentation 17 is located near the top end of the handle 16 so that an individual's thumb can have a resting area when the drinking apparatus 2 is being used.

The top edge 70 of the base unit 5, when connected to the fluid container 4, is curved. The highest point of the base unit 5 in relation to the fluid container 4 is located immediately underneath the attachment point where the top end of the handle 16 is attached to the fluid container 4. The lowest point of the base unit 5 in relation to the fluid container 4 is located one hundred eighty degrees away from the point where the handle is attached to the fluid container 4 and the base unit 5 of the drinking apparatus 2 highest point adjacent to an attached handle and the lowest point opposite the handle.

The area in between the outer surface 14 of the fluid container 4 and the base unit 5 has a sloping floor 50, with the sloping floor 50 being located approximately five to ten millimeters below the top edge of the base unit 5. In the sloping floor 50 are a plurality of drain holes 28 which each have two ends, a top end and a bottom end. The top end of each of the drain holes 28 are located on the sloping floor 50, while the bottom end of each drain hole ends in the fluid reservoir 8. The presence of the drain holes 28 ensures extra spilled liquid will travel into the fluid reservoir and not be located in the void in between the fluid container 4 and the base unit 5.

At least one of the drain holes 28 is to be placed at a location on the sloping floor 50 that is one hundred eighty degrees opposite the handle 16, which is the lowest point of the sloping floor 50. This would ensure that all of the extra spilled liquid within area in between the fluid container 4 and the base unit 5 will not remain in this area. Extra drain holes 28 could be placed to accommodate right- and left-handed cup holders to provide extra drainage relief for spilled liquid.

The drinking apparatus 2 also comprises a pair of sliding panels comprising a left sliding panel 18 and a right sliding panel 20. Normally, the sliding panels are mounted in an area underneath and close to the top end of the handle 16 when not in use. However, after liquid has been placed within the fluid container 4 and presumably, any spilled liquid had been captured and drained into the fluid reservoir 8, the sliding panels are utilized. This is done by grasping the left finger tab 30 of the left sliding panel 18 and opening the left sliding panel 18 by pulling the left finger tab 30 down and around the circumference of the fluid container 4 in a clockwise manner until the left finger tab 30 is located one hundred eighty degrees opposite the handle 16, at which time, the left sliding panel 18 covers half of the sliding floor 50. The same process is done with the right sliding panel 20 around the opposite side of the fluid container 4 by utilizing the right finger tab 32 and pulling the right sliding panel 20 around the circumference of the fluid container 4 in a counterclockwise manner, with the right finger tab 32 eventually resting right next to the left finger tab 30, at which time, the right sliding panel 20 also covers half of the sliding floor 50.

Each of the sliding panels comprises a plurality of curvilinear segments 26 that are interlocking with adjacent segments 26. Each of the finger tabs 30 is connected to the first segment of the respective sliding panel. In order to properly secure the segments 26 once each of the sliding panels are positioned, a plurality of inner grooves 22 and a plurality of outer grooves 24 are present.

The plurality of inner grooves 22 are located on the outer surface 14 of the fluid container, while the plurality of outer grooves 24 are located against the inner surface of the base unit 5 in between the top edge of the base unit 5 and the sloping floor 50. The height of the various inner grooves 22 are equal to the corresponding various outer grooves 24 so that each segment 26 is properly positioned when each of the sliding panels is fully extended.

When an individual wants to utilize the drinking apparatus 2, the sliding panels 18 and 20 would be positioned so they are retracted as much as possible underneath to and close to the handle 16. Then, a volume of drinkable liquid 60 is placed into the fluid container 4. While this occurs, any liquid 60 that is spilled over the rim 10 of the fluid container 4 will fall onto the sloping floor 50 and will eventually be drained into the fluid reservoir 8 through one or more of the drain holes 28. Once the liquid 60 is done being poured, the individual can fully extend both sliding panels 18 and 20 and proceed to drink the liquid. The previously split liquid, if any, will stay within the fluid reservoir 8. If any of the liquid does exit the fluid reservoir 8, it will stay in the area in between the sloping floor 50 and the plurality of segments 26 of the sliding panels 18 and 20. When an individual is done drinking the liquid 60 within the fluid container 4, he or she can retract the sliding panels 18 and 20 and can position the drinking apparatus 2, shaking it to get all of the split liquid, if any, out of the fluid reservoir 8.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A drinking apparatus comprising:

a base unit, the base including an outer lip, the base unit having a cross-sectional shape that is circular, the base unit having a top edge, the base unit also having an inner surface, the top edge of the base unit being curved, a fluid reservoir located within the base unit, a fluid container placed within the base unit, the fluid container having two surfaces comprising an inner surface and an outer surface, the fluid container also having a top-mounted rim, a handle having two ends, a top end and a bottom end, the top end of the handle being attached to the outer surface of the fluid container near the rim of the fluid container, the bottom end of the handle being attached to the outer lip of the base unit, a sloping floor located in between the top edge of the base unit and the outer surface of the fluid reservoir, a plurality of drain holes, each of the drain holes having two ends, a top end and a bottom end, the top end of each drain holes being located in the sloping floor, the bottom end of each drain hole ends in the fluid reservoir located within the base unit, a volume of liquid placed within the fluid container, means for capturing and retaining spilled liquid within the base unit, the spilled liquid originating from the volume of liquid placed within the fluid container, wherein the highest point of the top edge in relation to the fluid container is located immediately underneath the attachment point where the top end of the handle is attached to the fluid container, further wherein the lowest point of the base unit in relation to the fluid container is located one hundred eighty degrees away from the point where the handle is attached to the fluid container and the base unit, wherein the means for capturing and retaining spilled liquid within the base unit further comprises:

a plurality of inner grooves located on the outer surface of the container, the plurality of inner grooves being located near the sloping floor, a plurality of outer grooves located on the inner surface of the base unit in between the top edge of the base unit and the sloping floor, a pair of sliding panels comprising a left sliding panel and a right sliding panel, each of the sliding panels being mounted within the plurality of inner grooves and outer grooves, each of the sliding panels being located in an area underneath the top end of the handle when not in use, wherein the left sliding panel is opened by moving the left sliding panel around the circumference of the fluid container in a clockwise manner until the left sliding panel covers half of the sloping floor, further wherein the right sliding panel is opened by moving the right sliding panel around the circumference of the fluid container in a counterclockwise manner until the right sliding panel covers half of the sloping floor, further wherein any liquid previously spilled onto the sloping floor will remain trapped in the fluid reservoir or within the area in between the sloping floor and one of the sliding panels while the drinking apparatus is being used for consumption of the volume of liquid that is still located within the fluid container.

2. A drinking apparatus according to claim 1 wherein the sloping floor is located approximately five to ten millimeters below the height of the top edge of the base unit.

3. A drinking apparatus according to claim 2 wherein the left sliding panel and the right sliding panel are each fabricated from a plurality of curvilinear segments, wherein each of the curvilinear segments are interlocking with adjacent segments.

4. A drinking apparatus according to claim 3 wherein the handle further comprises an indentation located near the top end of the handle, the indentation designed to be a placement for an individual's thumb.

5. A drinking apparatus according to claim 4 wherein the left sliding panel further comprises a left finger tab, the left finger tab being attached to a curvilinear segment of the left sliding panel.

6. A drinking apparatus according to claim 4 wherein the right sliding panel further comprises a right finger tab, the right finger tab being attached to a curvilinear segment of the right sliding panel.

* * * * *